United States Patent [19]

Colles

[11] Patent Number: 4,814,688

[45] Date of Patent: Mar. 21, 1989

[54] REFERENCE GENERATOR

[75] Inventor: Joseph H. Colles, Oceanside, Calif.

[73] Assignee: Brooktree Corporation, San Diego, Calif.

[21] Appl. No.: 163,646

[22] Filed: Mar. 3, 1988

[51] Int. Cl.[4] ..... G05F 3/16

[52] U.S. Cl. ..... 323/317; 341/144

[58] Field of Search ..... 323/315, 316, 317; 341/144

[56] References Cited

U.S. PATENT DOCUMENTS

| | | | |
|---|---|---|---|
| 4,029,974 | 6/1977 | Brokaw | 323/315 |
| 4,280,091 | 7/1981 | Hiltner | 323/315 |
| 4,381,497 | 4/1983 | Lillis et al. | 323/315 |
| 4,555,642 | 11/1985 | Morales | 323/316 |
| 4,701,694 | 10/1987 | Penney et al. | 341/144 |
| 4,712,091 | 12/1987 | Schoofs et al. | 323/317 |

*Primary Examiner*—Patrick R. Salce
*Assistant Examiner*—Jeffrey Sterrett
*Attorney, Agent, or Firm*—Ellsworth R. Roston; Charles H. Schwartz

[57] ABSTRACT

A reference generator is used in a digital-to-analog converter to provide for a replication of colors in accordance with binary information introduced to the converter. The generator is responsive to binary signals each having first and second logic levels respectively representing binary "1" and binary "0" and each representing a different one of the binary colors red, green and blue. Each of the binary signals is introduced to an individual one of transistors in a first plurality. An energizing voltage is also introduced to the transistors to obtain a flow of current through such transistors in accordance with the logic levels of such input signals and the magnitude of the energizing voltage. A substantially constant current is provided at first particular times and a reference voltage is provided at other times. An impedance may be common to the circuit for the substantially constant current and the reference voltage. A first control is responsive to the constant current to maintain the energizing voltage at a substantially constant value. A second control is responsive to the reference voltage to maintain the energizing voltage at the substantially constant value. When the reference voltage is produced, the production of the substantially constant voltage from the constant current is overridden. The first and second controls for each of the different colors are disposed in an electrical circuit to provide an output from the circuit only in accordance with the logic levels of the binary signals. The first and second controls may respectively include transistors in second and third pluralities.

18 Claims, 1 Drawing Sheet

REFERENCE GENERATOR

Figure 1:
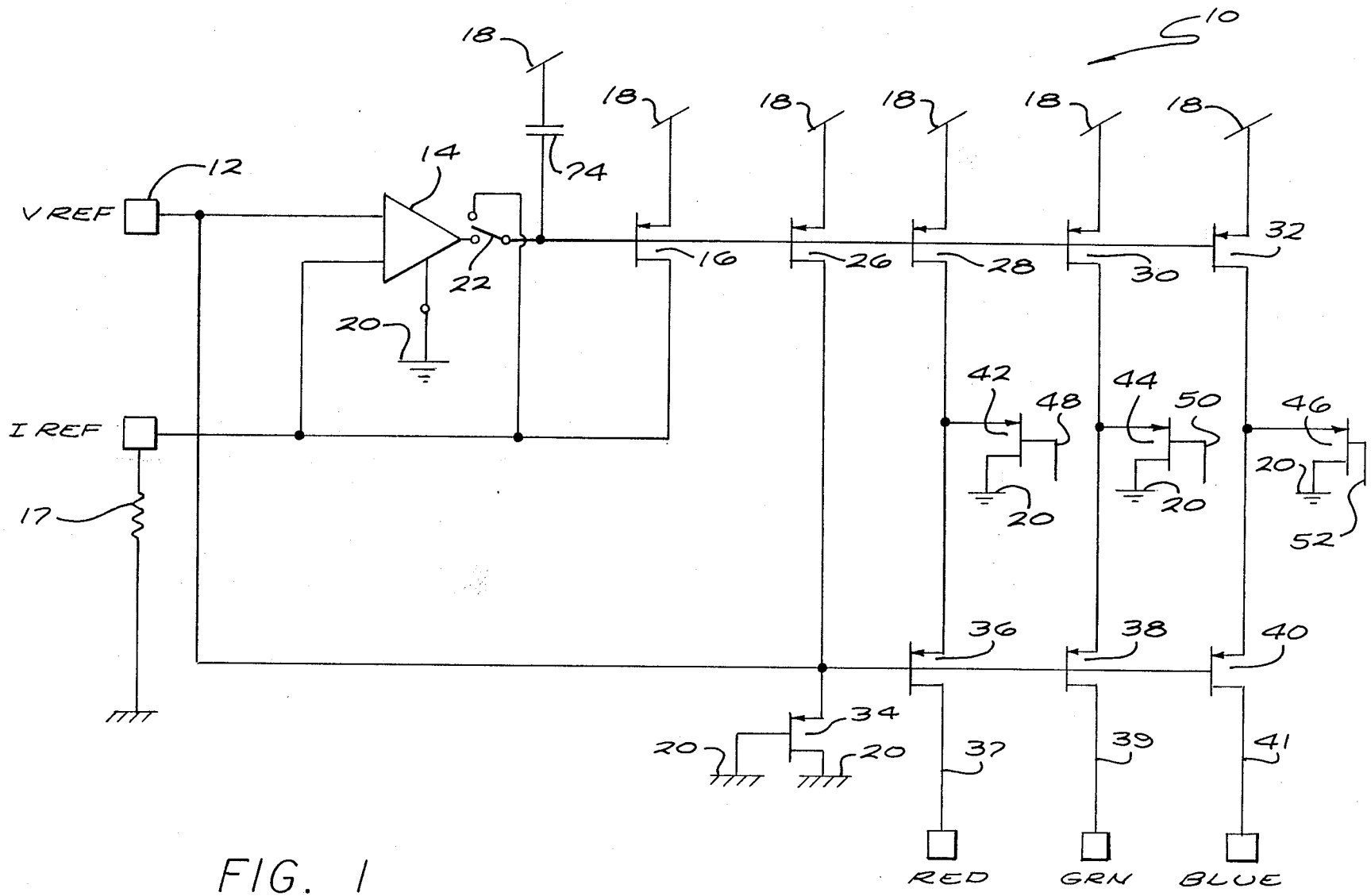

This invention relates to reference generators for use in apparatus for converting binary signals to analog signals. More particularly, the invention relates to apparatus for using a substantially constant current or a reference voltage to produce a substantially constant voltage for obtaining a precise conversion of a binary value to an analog value. The invention has particular utility in converting binary information relating to the primary colors such as red, green and blue into corresponding analog information.

Data processing systems are now in use for processing a wide variety of information. For example, data processing systems are now in use for aiding scientists and engineers in designing complex three-dimensional articles. Such data processing systems have been instrumental in materially shortening the time required to design such three-dimensional articles. The systems have also been instrumental in showing weaknesses and deficiencies in the design of such articles before prototypes of such articles have been constructed and tested. As a result, such data processing systems have proved to be a boon to suppliers of many different types of products.

Visual displays are included in many different data processing systems. For example, visual displays are included in the systems discussed in the previous paragraph for aiding scientists and engineers to design new products. Such visual displays are often in color. To provide such displays, data processing information in binary form is converted to an analog form for each of three (3) different primary colors such as red, green and blue. The colors are mixed at each different position to obtain a resultant color at that position. The resultant color for each position is then displayed on a visual screen.

Since the three different primary colors are mixed for each position, the conversion of the binary information to the analog information at each position for each color has to be quite precise. Different systems have been provided in the prior art to provide such precise conversion. In each of these prior art systems, a transistor receiving the binary information for each individual color has been energized with a substantially constant voltage to assure that the transistor will operate only in accordance with the binary input signal.

Two systems have been provided in the prior art for energizing each transistor receiving a binary input signal for each primary color. One of these systems receives a substantially constant current and produces the substantially constant voltage from this current. The other system receives a reference voltage and produces the substantially constant voltage from this reference voltage. One system has been used by certain suppliers and the other system has been used by other supplies.

As will be appreciated, it is desirable for a supplier to provide a system which can be easily adapted to provide the substantially constant voltage from either the substantially constant current or the reference voltage. This is particularly true since the converters discussed in the previous paragraph are disposed on an integrated circuit chip and the production of the substantially constant voltage for energizing the transistors providing the conversion are also disposed on this chip. By providing the chip with the capabilities of producing the substantially constant voltage either from a substantially constant current or a reference voltage, the chip is able to be used on a universal basis.

Since the desirability of producing a universal chip such as discussed in the previous paragraph has been known for some time, a considerable effort has been made, and significant amounts of money have been expended, to provide such a universal chip. Such effort and money expenditure have not been successful. No system has been provided which is adaptable to provide a substantially constant voltage, either from a substantially constant current or from a reference voltage, for energizing transistors in a converter.

This invention provides a universal integrated circuit chip for producing a substantially constant voltage, either from a substantially constant current or from a reference voltage, to energize transistors in a converter. These transistors provide a conversion of binary values to an analog value in accordance with the logic levels of binary signals introduced to the transistors. By energizing the transistors with the substantially constant voltage, the transistors are operative only in accordance with the logic levels of the binary signals introduced to the transistors.

In one embodiment of the invention, a reference generator is used in a digital-to-analog converter to provide for a replication of colors in accordance with binary information introduced to the converter. The generator is responsive to binary signals each having first and second logic levels respectively representing binary "1" and binary "0" and each representing a different one of the binary colors red, green and blue. Each of the binary signals is introduced to an individual one of transistors in a first plurality.

An energizing voltage is also introduced to the transistors to obtain a flow of current through such transistors in accordance with the logic levels of such input signals and the magnitude of the energizing voltage. A substantially constant current is provided at first particular times and a reference voltage is provided at other times. An impedance may be common to the circuits for the substantially constant current and the reference voltage.

A first control is responsive to the constant current to maintain the energizing voltage at a substantially constant value. A second control is responsive to the reference voltage to maintain the energizing voltage at the substantially constant value. When the reference voltage is produced, the production of the substantially constant voltage from the constant current is overridden. The first and second controls for each of the different colors are disposed in an electrical circuit to provide an output from the circuit only in accordance with the logic levels of the binary signals. The first and second controls may respectively include transistors in second and third pluralities.

In the drawings:

The single FIGURE is a circuit diagram of a reference generator constituting one embodiment of the invention.

In one embodiment of the invention, a reference generator generally indicated at 10 is shown in the single FIGURE for controlling the currents produced by a digital-to-analog converter in accordance with the logic levels of binary signals introduced to the converter. The reference generator 10 is particularly adapted to be used to convert binary signals relating to primary colors such as red, green and blue for different positions in a visual image into analog signals indicating the color information represented by such binary signals.

In the embodiment of the invention shown in the single FIGURE, a source 12 of a reference voltage such as approximately one and two tenths volt (1.2 V.) is connected to a first input terminal of an operational amplifier 14. The operational amplifier 14 may be constructed in a conventional manner. A second input terminal of the operational amplifier 14 is connected to the drain of a transistor 16, which may be a p-type. The drain of the transistor 16 is also in series with a grounded resistance 17 which is connected to provide a substantially constant current designated in the single FIGURE as "I REF". The source of the transistor 16 receives a positive potential from a voltage source 18.

The operational amplifier 14 includes a ground 20 at one of the terminals internal to the amplifier. The output terminal of the amplifier 14 has a common connection to one stationary terminal of a switch 22, the other stationary terminal of which is common to the gate of the transistor 16. A capacitance 24 is disposed electrically between the voltage source 18 and the gate of the transistor 16.

The voltage introduced to the gate of the transistor 16 is also introduced to the gates of transistors 26, 28, 30 and 32, each of which may be a p-type. The sources of the transistors 26, 28, 30 and 32 receive an energizing voltage from the voltage source 18. The drains of the transistors 26, 28, 30 and 32 are respectively common with the sources of transistors 34, 36, 38 and 40, all of which may be a p-type. The gate and drain of the transistor 34 are connected to the ground 20. The drains of the transistors 36, 38 and 40 are respectively connected to lines 37, 39 and 41 providing red, green and blue signals.

The sources of transistors 42, 44 and 46 are respectively connected to the drains of the transistors 28, 30 and 32. The drains of the transistors 42, 44 and 46 are grounded as at 20. The gates of the transistors 42, 44 and 46 respectively receive binary signals on lines 48, 50 and 52. The signals on the lines 48, 50 and 52 individually represent a binary value for the primary colors red, green and blue.

In the mode of operation where the reference generator 10 is disconnected, the switch 22 is open in the position shown. This isolates the operational amplifier 14 from the circuit and prevents the reference voltage from the source 12 from affecting the operation of the reference generator 10. This is true even though a reference voltage may be provided by the source 12 at this time.

When the reference current transistor 16 receives a substantially constant flow of current indicated as "I REF", this current flows through a circuit including the voltage source 18, the transistor 16 and the resistance 17. This current produces a substantially constant voltage across the resistance 17. This voltage, applied to the gate of the transistor 16 with the switch 22 in the up position, is exactly the voltage required to cause the current "I REF" to flow between the gate and the drain of transistor 16.

The voltage on the gate of the transistor 16 is introduced to the gates of the transistors 26, 28, 30 and 32. This causes a current substantially equal to "I REF" to flow through several transistors including the circuit consisting of the voltage source 18, the transistor 26 and the transistor 34. The flow of current through the transistor 34 causes a substantially constant voltage such as approximately one and two tenths volt (1.2 V.) to be produced on the source of the transistor.

The voltage on the source of the transistor 34 provides a substantially constant voltage bias on the gates of the transistors 36, 38 and 40. Since a substantially constant voltage is also introduced to the gates of the transistors 28, 30 and 32, a substantially constant current flows through the transistors 28, 30 and 32 and a substantially constant voltage is produced on the sources of the transistors 36, 38 and 40, provided that the transistors 42, 44 and 46 are turned off by their respective input logic levels.

Since the transistors 42, 44 and 46 are turned off, current will flow through these transistors only when the logic levels of the signals on the gates of the transistors drop to a low voltage or logic low state. Logic low states at the gates of the transistors 42, 44 and 46 divert the current from transistors 36, 38 and 40 since the substantially constant current through the transistors 28, 30 and 32 is divided between the current through the transistors 42, 44 and 46 and the current through the transistors 36, 38 and 40. As a result, the current flowing through the lines 37, 39 and 41 respectively represent the logic levels introduced to the gates of the transistors 48, 50 and 52.

The switch 22 is in the down position when the reference generator 10 is to respond to the reference voltage ("V REF" in the single FIGURE) from the reference voltage source 12. This reference voltage may be approximately one and two tenths volts (1.2 V.). This reference voltage is introduced to the operational amplifier 14 which produces on its output terminal a voltage which is introduced through the closed switch 22 to the gate of the transistor 16. Current accordingly flows through a circuit including the voltage source 18, the transistor 16 and the resistance 17.

The voltage produced across the resistance 17 by the flow of current through the resistance is substantially one and two tenths volts (1.2 V.) This voltage is introduced to the second input terminal of the operational amplifier 14 and results in an output voltage appropriate to maintain the voltage input to the operational amplifier substantially equal to the reference (1.2 V) voltage. In this way, the resistance 17 is included in a feedback circuit to maintain the current through the transistor 16 at a substantially constant and predictable value.

Unlike the previous mode of operation, V REF rather than the transistor 34 establishes the substantially constant voltage on the sources of the transistors 36, 38 and 40 when their current flow is substantially equal to the constant current ("I REF" in the single FIGURE) through the resistance 17. The transistor 34 plays no significant role in this mode of operation since the voltage at the V REF terminal (12) establishes the voltage at the source of the transistor 34.

The substantially constant voltage produced on the gate of the transistor 16 by the operational amplifier 14 is introduced to the gates of the transistors 28, 30 and 32 to produce a substantially constant current through the transistors and a substantially constant voltage on the sources of the transistors 36, 38 and 40. This is true except when the logic signals at the inputs of the transistors 42, 44 and 46 cause the constant currents generated by transistors 28, 30 and 32 to be diverted. As a result, the flow of current through the lines 37, 39 and 41 is affected only by the logic levels of the binary input signals introduced to the gates of the transistors 42, 44 and 46.

Distributed capacitances respectively exist on the integrated circuit chip between the sources of the transistors 42, 44 and 46 and the gates of the transistors 26, 28 and 30. These distributed capacitances may affect the production of the substantially constant current through the transistors 36, 38 and 40 even though the distributed capacitances may be in the picofarad range. To offset any effect of these distributed capacitances on the production of the substantially constant current at the drains of the transistors 36, 38 and 40, the capacitance 24 is provided between the voltage source 18 and the gate of the transistor 16. The value of this capacitance may be about a hundredth of a microfarad (0.01 fd). This capacitance causes the voltage at the gates of transistors 16, 26, 28, 30 and 32 to remain substantially constant in the presence of changing logic levels at the inputs of the transistors 42, 44 and 46.

It will be appreciated that the currents in the output lines 37, 39 and 41 represent only one binary stage. For example, the currents through the lines 37, 39 and 41 may be for only the stage of least binary significance. Circuits similar to those shown in FIG. 1 may be provided for each of the stages of progressive binary significance. These circuits provide currents on output lines corresponding to the lines 37, 39 and 41. The currents on the different output lines for each position in the visual display are then processed to produce the color for that particular position.

The reference generator described above has certain important advantages. It receives a substantially constant current at first times and produces a substantially constant voltage for introduction to control stages. These control signals then operate to produce on output lines (such as the lines 37, 39 and 41) a current only in accordance with the logic levels of binary signals providing color information for a particular position in a visual display. The reference generator also receives a reference voltage at other times and produces the substantially constant voltage for introduction to the control stages. When the reference voltage is introduced to the reference generator 10, the reference generator operates to override the stages producing the substantially constant voltage during the introduction of the substantially constant current.

Although this invention has been disclosed and illustrated with reference to particular embodiments, the principles involved are susceptible for use in numerous other embodiments which will be apparent to persons skilled in the art. The invention is, therefore, to be limited only as indicated by the scope of the appended claims.

I claim:

1. A reference generator for use in a digital-to-analog converter to provide for a replication of colors in accordance with binary information introduced to the converter, including, an operational amplifier, means for introducing a reference voltage to the operational amplifier at first particular times, means including an impedance for providing a substantially constant current at second particular times different from the first particular times, means including the impedance for providing a feedback of the output of the operational amplifier to the input to the operational amplifier to maintain the production of the reference voltage by the operational amplifier during the first particular times, a first plurality of transistors each constructed to produce a current of a first particular magnitude upon the introduction of a signal of a first logic level and to produce a current of a second particular magnitude upon the introduction of a signal of a second logic level, a second plurality of transistors, means responsive to the voltage on the impedance at the second particular times for introducing such voltage to each of the transistors in the second plurality to maintain a substantially constant current through each such transistor and to obtain the production of a substantially constant voltage from such transistor, means responsive to the output of the operational amplifier at the first particular times for overriding the operation of the last mentioned means to introduce the reference voltage to the transistors in the second plurality to maintain the substantially constant current through such transistors and to obtain the production of the substantially constant voltage from such transistors, means for introducing to each of the transistors in the first plurality the substantially constant voltage produced by the corresponding one of the transistors in the second plurality, and means for introducing to each of the transistors in the first plurality a binary signal having the first logic level in representation of a binary "1" and having the second logic level in representation of a binary "0" to obtain an output from the second transistor only in accordance with the logic level of such signal.

2. A reference generator as set forth in claim 1, including, means for normally preventing the introduction of the output of the operational amplifier to the transistors in the second plurality to provide for the operation of such transistors in accordance with the voltage on the impedance, and means for providing for a bridging of the output of the operational amplifier to the transistors in the second plurality at the first particular times.

3. A reference generator as set forth in claim 2, including, a third plurality of transistors each connected in a circuit with an individual one of the transistors in the second plurality, and means for introducing the voltage from the operational amplifier to each of the transistors in the third plurality to obtain the production of the substantially constant voltage from each of the associated second transistors.

4. A reference generator as set forth in claim 3, including, means connected in a circuit with the operational amplifier for compensating for distributed capacitances between each of the transistors in the first plurality and the associated one of the transistors in the third plurality to maintain the introduction of the reference voltage from the operational amplifier to the transistors in the third plurality.

5. A reference generator for use in a digital-to-analog converter to provide for a replication of colors in accordance with binary information introduced to the converter, including, a plurality of transistors, means for providing a plurality of input signals each having a first logic level representing a binary "1" and having a second logic level representing a binary "0" and each representing an individual one of the primary colors in accordance with such logic level, means for introducing individual ones of the input signals in the plurality to individual ones of the transistors to control the state of operation of such transistors in accordance with the logic levels of such input signals, means for providing for the introduction of an energizing voltage to the transistors in the plurality to obtain a flow of current through such transistors in accordance with the logic levels of the input signals and the magnitude of the energizing voltage, means for providing a substantially constant current at first particular times, means for providing a reference voltage at second particular times different from the first particular times, first control means responsive to the substantially constant current for maintaining the energizing voltage at a substantially constant value, second control means responsive to the reference voltage for maintaining the energizing voltage at the substantially constant value, and means responsive to the reference voltage for overriding the first control means.

6. A reference generator as set forth in claim 5, including, means for compensating for distributed capacitances between each of the transistors in the plurality and the second control means to maintain the production of the substantially constant value for the energizing voltage when the overriding means is operative to override the first control means.

7. A reference generator as set forth in claim 6, including, an operational amplifier included in the second control means and also included in the compensating means.

8. A reference generator as set forth in claim 7, including, an impedance, the constant current means including the impedance, and the reference voltage means including the impedance.

9. A reference generator for use in a digital-to-analog converter to provide for a replication of colors in accordance with binary information introduced to the converter, including, means for providing a reference voltage, means for providing a substantially constant current, means for providing a plurality of input signals each having first and second logic levels respectively representing a binary "1" and a binary "0", a plurality of output means each responsive to an individual one of the input signals to produce an output signal in accordance with the logic level of such input signal, first control means responsive to the reference voltage for introducing a substantially constant voltage to each of the output means to provide for variations of the output signal from such output means only in accordance with the logic level of the input signal introduced to such output means, second control means responsive to the substantially constant current for producing the substantially constant voltage and for introducing such substantially constant voltage to each of the output means to provide for variations of the output signal from such output means only in accordance with the logic level of the output signals introduced to such output means, and means for overriding the effect of the second control means when the first control means is operative to produce the substantially constant voltage.

10. A reference generator as set forth in claim 9, including, an operational amplifier responsive to the reference voltage for producing the substantially constant voltage for introduction to the output signal means, and means for providing for the operation of the operational amplifier only when the reference voltage is produced.

11. A reference generator as set forth in claim 10, including, a transistor having a drain, a gate and a source, the drain and the gate being connected to each other and the constant current means for the production of the substantially constant voltage for introduction to the output signal means.

12. A reference generator as set forth in claim 11, including, a third plurality of transistors each having first, second and third electrodes, the third electrode in each of the transistors in the second plurality being connected to the second electrodes of associated ones of the transistors in the first and third pluralities, and means for introducing the substantially constant voltage from the current converting means to the first electrodes in the transistors in the third plurality to obtain voltages from the third electrodes in each of the transistors in the third plurality only in accordance with the logic level of the binary signal introduced to the first electrode of the associated one of the transistors in the first plurality.

13. A reference generator as set forth in claim 9, including, a first plurality of transistors each operatively coupled to the reference voltage means for producing the substantially constant voltage for introduction to an individual one of the output signal means, a second plurality of transistors each responsive to the constant current means for producing the substantially constant voltage for introduction to an individual one of the output signal means, each of the transistors in the first plurality being connected in a circuit with an individual one of the transistors in the second plurality to provide for a flow of current through such circuit to obtain the production of the substantially constant voltage in such circuit.

14. A reference generator as set forth in claim 13, including, an operational amplifier responsive to the reference voltage for producing the substantially constant voltage for introduction to the output signal means, means for providing for the operation of the operational amplifier only when the reference voltage is produced, an impedance, the constant current means including the impedance, and the reference voltage means including the operational amplifier and the impedance.

15. A reference generator as set forth in claim 9, including, an impedance, the constant current means including the impedance, and the reference voltage means including the impedance.

16. A reference generator for use in a digital-to-analog converter to provide for a replication of colors in accordance with binary information introduced to the converter, including, means for providing a plurality of binary signals each having first and second logic levels respectively representing binary "1" and binary "0" and each representing a different one of the binary colors red, green and blue, a plurality of transistors each having first, second and third electrodes, means for introducing an individual one of the binary signals to the first electrode in each of the transistors in the plurality, means for providing an energizing voltage, means for introducing the energizing voltage to the second electrode in each of the transistors in the plurality, means for normally providing a substantially constant current, first control means responsive to the substantially constant current for providing a substantially constant voltage and for introducing such substantially constant voltage to the energizing voltage means for use as the energizing voltage, means for providing a reference voltage, second control means responsive to the reference voltage for providing the substantially constant voltage and for introducing such substantially constant voltage to the energizing voltage means for use as the energizing voltage, means for providing for the production of the reference voltage only at pre-selected times, and means responsive to the production of the reference voltage for overriding the production of the substantially constant voltage from the substantially constant current, and means for obtaining an output only in accordance with the logic levels of the binary signals.

17. A reference generator as set forth in claim 16, including, a second plurality of transistors each having first, second and third electrodes, means for converting the substantially constant current to the substantially constant voltage, means for introducing the substantially constant voltage from the current converting means to the first electrodes in the transistors in the second plurality, and means for connecting the second control means and the first electrodes in the transistors in the first plurality to the second electrodes of the transistors in the second plurality to obtain an output from each of the third electrodes of the transistors in the second plurality only in accordance with the logic levels of the binary signals.

18. A reference generator as set forth in claim 16, including, a second plurality of transistors each having first, second and third electrodes, means for applying the reference voltage to the first electrodes in the transistors in the second plurality, a source of voltage connected to the third electrodes in the transistors in the third plurality, and means for introducing the voltages on the third electrodes to the second electrodes in the transistors in the first plurality as the substantially constant voltage.

* * * * *

UNITED STATES PATENT AND TRADEMARK OFFICE

CERTIFICATE OF CORRECTION

PATENT NO. : 4,814,688

DATED : MARCH 21, 1989

INVENTOR(S) : JOSEPH H. COLLES

It is certified that error appears in the above-identified patent and that said Letters Patent is hereby corrected as shown below:

Column 6, line 31, change "the second" to --such--.

line 51, change "third" to --second--.

line 58, change "first" to --second--.

line 62, change "third" to --second--.

Column 9, line 27, change "second" to --first--.

Signed and Sealed this

Twenty-first Day of August, 1990

*Attest:*

HARRY F. MANBECK, JR.

*Attesting Officer*

*Commissioner of Patents and Trademarks*

US004814688B1

REEXAMINATION CERTIFICATE (1970th)

United States Patent [19]

Colles

[11] B1 4,814,688

[45] Certificate Issued Apr. 6, 1993

[54] REFERENCE GENERATOR

[75] Inventor: Joseph H. Colles, Oceanside, Calif.

[73] Assignee: Brooktree Corporation, San Diego, Calif.

Reexamination Request:
No. 90/002,418, Aug. 26, 1991

Reexamination Certificate for:

| | |
|---|---|
| Patent No.: | **4,814,688** |
| Issued: | **Mar. 21, 1989** |
| Appl. No.: | **163,646** |
| Filed: | **Mar. 3, 1988** |

Certificate of Correction issued Aug. 21, 1990.

[51] Int. Cl.[5] ..... G05F 3/16
[52] U.S. Cl. ..... 323/317; 341/144

[56] References Cited

FOREIGN PATENT DOCUMENTS 56-115027 9/1981 Japan .

OTHER PUBLICATIONS

AD390 Data Sheet, published in Analog Devices, Data Acquisition Databook 1984, vol. I, pp. 9-27 through 9-34.

AD9702 Data Sheet, published in Analog Devices, Data Acquisition Databook Update and Selection Guide 1986, pp. 3-319 thru 3-322.

AD9768 Data Sheet, published in Analog Devices, Data-Acquisition Databook 1984, vol. 1, pp. 9-261 through 9-264.

Telmos publication: "TML1840 Video DAC": Mar. 1984, published by Telmos, Inc.

*Primary Examiner*—Jeffrey Sterrett

[57] ABSTRACT

A reference generator is used in a digital-to-analog converter to provide for a replication of colors in accordance with binary information introduced to the converter. The generator is responsive to binary signals each having first and second logic levels respectively representing binary "1" and binary "0" and each representing a different one of the binary colors red, green and blue. Each of the binary signals is introduced to an individual one of transistors in a first plurality. An energizing voltage is also introduced to the transistors to obtain a flow of current through such transistors in accordance with the logic levels of such input signals and the magnitude of the energizing voltage. A substantially constant current is provided at first particular times and a reference voltage is provided at other times. An impedance may be common to the circuit for the substantially constant current and the reference voltage. A first control is responsive to the constant current to maintain the energizing voltage at a substantially constant value. A second control is responsive to the reference voltage to maintain the energizing voltage at the substantially constant value. When the reference voltage is produced, the production of the substantially constant voltage from the constant current is overridden. The first and second controls for each of the different colors are disposed in an electrical circuit to provide an output from the circuit only in accordance with the logic levels of the binary signals. The first and second controls may respectively include transistors in second and third pluralities.

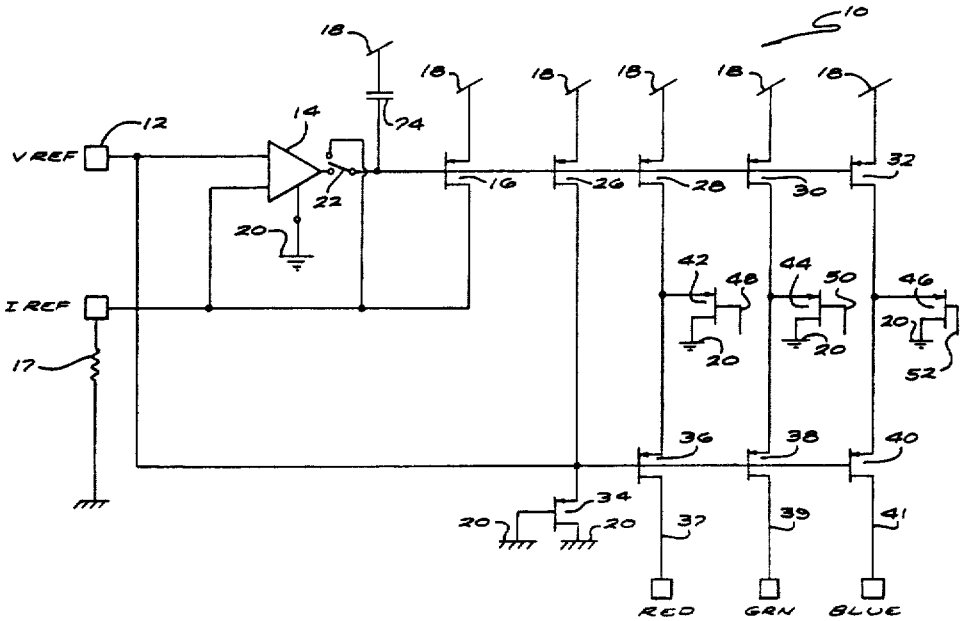

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 5–8 is confirmed.

Claims 1, 3, 4, 9–14 and 16–18 are determined to be patentable as amended.

Claims 2, 3, 4 and 15, dependent on an amended claim, are determined to be patentable.

New claims 19–39 are added and determined to be patentable.

1. A reference generator for use in a digital-to-analog converter to provide for a replication of colors in accordance with binary information introduced to the converter, including, an operational amplifier, means for introducing a reference voltage to the operational amplifier at first particular times, means including an impedance for providing a substantially constant current at second particular times different from the first particular times, means including the impedance for providing a feedback of the output of the operational amplifier to the input to the operational amplifier to maintain the production of *a voltage corresponding to* the reference voltage [by the operational amplifier] *across the impedance* during the first particular times, a first plurality of transistors each constructed to produce a current of a first particular magnitude upon the introduction of a signal of a first logic level and to produce a current of a second particular magnitude upon the introduction of a signal of a second logic level, a second plurality of transistors, means responsive to the voltage on the impedance at the second particular times for introducing such voltage to each of the transistors in the second plurality to maintain a substantially constant current through each such transistor and to obtain the production of a substantially constant voltage from such transistor, means [responsive to the output of the operational amplifier] *including the operational amplifier responsive to the reference voltage and operative* at the first particular times for overriding the operation of the last mentioned means, [to introduce]*providing for the introduction of said voltage corresponding to* the reference voltage to the transistors in the second plurality to maintain the substantially constant current through such transistors, and [to obtain] *obtaining* the production of the substantially constant voltage from such transistors, means for introducing to each of the transistors in the first plurality the substantially constant voltage produced by [the] *a* corresponding one of the transistors in the second plurality, and means for introducing to each of the transistors in the first plurality [a binary] *the* signal having the first logic level in representation of a binary "1" and having the second logic level in representation of a binary "0" to obtain an output from such transistor *in the first plurality* only in accordance with the logic level of such signal.

9. A reference generator for use in a digital-to-analog converter to provide for a replication of colors in accordance with binary information introduced to the converter, including, means for providing a reference voltage, means for providing a substantially constant current, means for providing a plurality of input signals each having first and second logic levels respectively representing a binary "1" and a binary "0", a plurality of output means each responsive to an individual one of the input signals to produce an output signal in accordance with the logic level of such input signal, first control means responsive to the reference voltage for introducing a substantially constant voltage to each of the output means *in the plurality* to provide for variations of the output signal from such output means *in the plurality* only in accordance with the logic level of the input signal introduced *in the plurality* to such output means *in the plurality*, second control means responsive to the substantially constant current for producing the substantially constant voltage and for introducing such substantially constant voltage to each of the output means *in the plurality* to provide for variations of the output signal from such output means *in the plurality* only in accordance with the logic level of the [output] *input* signals introduced to such output means *in the plurality*, and means for overriding the effect of the second control means when the first control means is operative to produce the substantially constant voltage *and when the reference voltage is provided.*

10. A reference generator as set forth in claim 9, including, an operational amplifier *included in the first control means and* responsive to the reference voltage for producing the substantially constant voltage [and] for introduction to the output [signal] means *in the plurality*, and means for providing for the operation of the operational amplifier only when the reference voltage is [produced] *provided.*

11. A reference generator as set forth in claim 10, including, a transistor having a drain, a gate and a source, the drain and the gate being connected to each other and the [constant current] *source being connected to the output* means *in the plurality* for the production of the substantially constant voltage for introduction to the output [signal] means *in the plurality.*

12. A reference generator as set forth in claim 11, including,

[a] *first, second and* third [plurality] *pluralities* of transistors each having first, second and third electrodes,

*the output means in the plurality including the transistors in the third plurality,* the third electrode in each of the transistors in the second plurality being connected to the second electrodes of associated ones of the transistors in the first and third pluralities, and means for introducing the substantially constant voltage from the [current converting means] *source of the transistor* to the first electrodes in the transistors in the third plurality to obtain [voltages from] *the output signal at* the third [electrodes] *electrode* in each of the transistors in the third plurality only in accordance with the logic level of the binary signal introduced to the first electrode of the associated one of the transistors in the first plurality.

13. A reference generator as set forth in claim 9, including, a first plurality of transistors each operatively coupled to the reference voltage means for producing the substantially constant voltage for introduction to an individual one of the output [signal] means *in the plurality, and*

[a second plurality of] *each of the* transistors [each] *in the first plurality being* responsive to the constant current means for producing the substantially constant voltage for introduction to an individual one of the output [signal] means *in the plurality,*

*the output means in the plurality including a second plurality of transistors,* each of the transistors in the first plurality being connected in a circuit with an individual one of the transistors in the second plurality to provide for a flow of current through such circuit to obtain the production of the [substantially constant voltage in such circuit] *output signals in the transistors in the second plurality.*

14. A reference generator as set forth in claim 13, including, an operational amplifier *included in the first control means and* responsive to the reference voltage for producing the substantially constant voltage for introduction to the output [signal] means *in the plurality,* means for providing for the operation of the operational amplifier only when the reference voltage is [produced] *provided,* an impedance, the constant current means including the impedance, and the reference voltage means including the operational amplifier and the impedance.

16. A reference generator for use in a digital-to-analog converter to provide for a replication of colors in accordance with binary information introduced to the converter, including, means for providing a plurality of binary signals each having first and second logic levels respectively representing binary "1" and binary "0" and each representing a different one of the binary colors red, green and blue, a plurality of transistors each having first, second and third electrodes, means for introducing an individual one of the binary signals to the first electrode in each of the transistors in the plurality, means for providing an energizing voltage, means for introducing the energizing voltage to the first electrode in each of the transistors in the plurality, means for normally providing a substantially constant current, first control means responsive to the substantially constant current for providing a substantially constant voltage and for introducing such substantially constant voltage to the energizing voltage means for [use as] *the production of* the energizing voltage, means for providing a reference voltage, second control means responsive to the reference voltage for providing the substantially constant voltage and for introducing such substantially constant voltage to the energizing voltage means for [use as] *the production of* the energizing voltage, means for providing [for the production of] the reference voltage only at pre-selected times, and means responsive to the [production] *provision* of the reference voltage for overriding the production of the substantially constant voltage from the substantially constant current, and means for obtaining an output *from the transistors in the plurality* only in accordance with the logic levels of the binary signals.

17. A reference generator as set forth in claim 16, including, a second plurality of transistors each having first, second and third electrodes,

*the first control means including* means for converting the substantially constant current to the substantially constant voltage,

*the first control means including* means for introducing the substantially constant voltage from the current converting means to the [first] *second* electrodes in the transistors in the second plurality, and means for connecting the second control means and the first [electrodes in the transistors in the first plurality] *control means* to the second electrodes of the transistors in the second plurality to obtain an output from each of the third electrodes of the transistors in the [second] *first* plurality only in accordance with the logic levels of the binary [signals] *signal.*

18. A reference generator as set forth in claim 16, including, a second plurality of transistors each having first, second and third electrodes, means for applying the reference voltage to the [first] *second* electrodes in the transistors in the second plurality, a source of voltage connected to the [third] *first* electrodes in the transistors in the [third] *second* plurality, and means for introducing the voltage on the third electrodes *in the transistors in the second plurality* to the [second] *first* electrodes in the transistors in the first plurality as the substantially constant voltage.

*19. A reference generator as set forth in claim 18, including,*

*a third plurality of transistors each having first, second and third electrodes,*

*means for introducing the binary signals to the second electrodes of the transistors in the third plurality,*

*means for providing a ground at the third electrodes of the transistors in the third plurality, and*

*means for connecting the first electrodes of the transistors in the third plurality to the first electrodes of the transistors in the first plurality and the third electrodes in the transistors in the second plurality.*

*20. A reference generator as set forth in claim 19 wherein*

*the overriding means includes a line connected between the reference voltage means and the second electrodes of the transistors in the first plurality.*

*21. A reference generator as set forth in claim 16 wherein*

*the second control means includes an additional transistor and an operational amplifier and wherein the operational amplifier has a first input terminal connected to the reference voltage means and a second input terminal responsive to the voltage from the additional transistor and wherein the output from the operational amplifier is introduced to the additional transistor to regulate the flow of current through the additional transistor.*

*22. A reference generator as set forth in claim 20 wherein*

*the second control means includes an additional transistor having first, second and third electrodes and also includes an operational amplifier and wherein the operational amplifier has a first input terminal connected to the reference voltage means and a second input terminal responsive to the voltage on the third electrode of the additional transistor and wherein the output from the operational amplifier is introduced to the second electrode of the additional transistor to regulate the flow of current through the additional transistor.*

*23. A reference generator as set forth in claim 22 wherein*

*the first electrode of the additional transistor and the first electrodes of the transistors in the second plurality receive the voltage from the voltage source and the second electrodes of the transistors in the second plurality receive the output from the operational amplifier.*

*24. A reference generator as set forth in claim 16 wherein*

*a switch having first and second operative relationships is included and wherein the first control means includes the switch in the first operative relationship and the second control means includes the switch in the second operative relationship.*

*25. A reference generator as set forth in claim 23 wherein*

*the overriding means includes a line connected between the reference voltage means and the second electrode of the transistors in the first plurality and wherein a switch having first and second operative relationships is included and wherein the first control means includes the switch in the first operative relationship and the second control means includes the switch in the second operative relationship.*

*26. A reference generator as set forth in claim 4, including*

*the output from the operational amplifier being introduced to the transistors in the second plurality at the first particular times.*

*27. A reference generator as set forth in claim 8, including*

*the first control means including first and second additional transistors connected in a circuit and responsive to the voltage across the impedance at the first particular times for maintaining the energizing voltage at the substantially constant value.*

*28. A reference generator as set forth in claim 27, including*

*the first additional transistor in the first control means being responsive to the voltage across the impedance at the first particular times and being connected to the second additional transistor for producing a particular voltage at the second additional transistor, and*

*the second additional transistor being connected to the transistors in the plurality to introduce the particular voltage at the second additional transistor to the transistors in the plurality at the first particular times to maintain the energizing voltage at the transistors in the plurality at the substantially constant value.*

*29. A reference generator as set forth in claim 28, including*

*the means for providing the input signals including a second plurality of transistors responsive to the input signals for providing first and second states of operation in accordance with the first and second logic levels in the input signals and respectively connected to the transistors in the first plurality to control the operation of the transistors in the first plurality in accordance with the operation of the transistors in the second plurality in the first and second states.*

*30. A reference generator as set forth in claim 29, including*

*a third plurality of transistors each responsive to the voltage across the impedance at the first particular times and to the output from the operational amplifier at the second particular times to obtain a flow of a substantially constant current through such transistor and either an associated one of the transistors in the first plurality or an associated one of the transistors in the second plurality in accordance with the first or second logic levels in an associated one of the input signals.*

*31. A reference generator as set forth in claim 30, including*

*a third additional transistor,*

*the operational amplifier including first and second inputs and an output, the output of the operational amplifier being coupled to the first and third additional transistors and to the transistors in the third plurality and the first input to the operational amplifier being connected to the reference voltage means and the second input to the operational amplifier being coupled to the third additional transistor to obtain the flow of the substantially constant current through the transistors in the third plurality.*

*32. A reference generator as set forth in claims 31 wherein*

*the transistors in the first, second and third pluralities are p-transistors and wherein the first, second and third additional transistors are p-transistors.*

*33. A reference generator as set forth in claim 32, including*

*each of the transistors in the first, second and third pluralities and the first, second and third additional transistors having first, second and third electrodes,*

*the first electrodes in the first and third additional transistors and in the transistors in the third plurality*

*being responsive to the voltage across the impedance at the first particular times and to the output from the operational amplifier at the second particular times,*

*the overriding means being connected to the first electrodes of the transistors in the first plurality,*

*the energizing voltage at the substantially constant value being introduced to the second electrodes of the transistors in the first plurality,*

*the input signals being introduced to the first electrodes in the transistors in the second plurality, and*

*the third electrodes of the transistors in the third plurality being connected to the second electrodes of the transistors in the first and second pluralities.*

*34. A reference generator as set forth in claim 33, including*

*an output line,*

*the third electrodes of the transistors in the first plurality being connected to the output line,*

*means for providing an operating voltage,*

*the second electrodes in the transistors in the third plurality receiving the operating voltage.*

*35. A reference generator as recited in claim 34, including*

*the second electrode in the third additional transistor receiving the operating voltage and the voltage on the third electrode of the third additional transistor being introduced to the second input to the operational amplifier,*

*the second electrode in the first additional transistor receiving the operating voltage and the third electrode in the first additional transistor being connected to the second electrode in the second additional transistor,*

*the second and third electrodes in the second additional transistor and the third electrodes in the transistors in the second plurality receiving a ground potential.*

*36. A reference generator as recited in claim 5 wherein the overriding means includes a line connected between the reference voltage means and the transistors in the plurality.*

*37. A reference generator as set forth in claim 5 wherein a switch is provided with first and second operational relationships, and*

*the first control means includes the switch in the first operational relationship and the second control means includes the switch in the second operational relationship.*

*38. A reference generator as set forth in claim 36 wherein*

*a switch is provided with first and second operational relationships and the first control means includes the switch in the first operational relationship and the second control means includes the switch in the second operational relationship.*

*39. A reference generator as set forth in claim 35 wherein*

*the overriding means includes a line connected between the reference voltage means and the second electrode of the second additional transistor and the first electrodes of the transistors in the first plurality.*

* * * * *